US007761222B1

(12) United States Patent
Ruiz

(10) Patent No.: US 7,761,222 B1
(45) Date of Patent: Jul. 20, 2010

(54) FUEL INJECTOR FLOW SHIFT COMPENSATION IN INTERNAL COMBUSTION ENGINE

(75) Inventor: Victoriano Ruiz, Brighton, MI (US)

(73) Assignee: Caterpillar Inc, Peoria, IL (US)

( * ) Notice: Subject to any disclaimer, the term of this patent is extended or adjusted under 35 U.S.C. 154(b) by 12 days.

(21) Appl. No.: 12/317,746

(22) Filed: Dec. 29, 2008

(51) Int. Cl.
*F02M 51/00* (2006.01)

(52) U.S. Cl. ..... 701/105; 701/110; 123/436; 123/480

(58) Field of Classification Search ..... 123/436, 123/472, 478, 480, 486; 701/102, 106, 110; 73/114.38, 114.42, 114.45, 114.49
See application file for complete search history.

(56) References Cited

U.S. PATENT DOCUMENTS

| | | | | |
|---|---|---|---|---|
| 4,265,200 | A | 5/1981 | Wessel et al. | |
| 4,512,317 | A | 4/1985 | Pauwels et al. | |
| 5,036,818 | A | 8/1991 | Nuti | |
| 5,218,945 | A | 6/1993 | Kapellen et al. | |
| 5,222,022 | A | 6/1993 | Adams et al. | |
| 5,533,492 | A * | 7/1996 | Willey et al. | 123/681 |
| 5,732,676 | A | 3/1998 | Weisman et al. | |
| 6,220,223 | B1 | 4/2001 | Weisman, II et al. | |
| 6,289,877 | B1 | 9/2001 | Weisbrod et al. | |
| 6,588,398 | B1 | 7/2003 | Rodier | |
| 6,671,614 | B2 | 12/2003 | Weisman, II et al. | |
| 6,732,716 | B2 | 5/2004 | Bootle et al. | |
| 6,748,928 | B2 | 6/2004 | Shingole | |
| 6,814,053 | B2 | 11/2004 | Hawkins et al. | |
| 6,850,835 | B1 | 2/2005 | Barnes et al. | |
| 6,964,261 | B2 | 11/2005 | Warne et al. | |
| 7,219,004 | B2 | 5/2007 | Kolmanovsky et al. | |
| 2002/0185086 | A1 | 12/2002 | Newman et al. | |
| 2005/0061299 | A1 | 3/2005 | Leman et al. | |
| 2007/0289584 | A1 | 12/2007 | Nagel et al. | |

* cited by examiner

*Primary Examiner*—Hai H Huynh
(74) *Attorney, Agent, or Firm*—Liell & McNeil

(57) ABSTRACT

A method of operating a fuel injected multi-cylinder internal combustion engine includes establishing a flow shift compensation term by comparing a pre-flow shift value with a post-flow shift value. The pre-flow shift value is indicative of a pre-flow shift fueling signal duration linked with an engine test speed, and the post-flow shift value is indicative of a post-flow shift fueling signal duration linked with the engine test speed. The method further includes controlling an engine speed via outputting fueling signals from a digital engine speed governor to a plurality of fuel injectors of the internal combustion engine. The fueling signals have a fueling signal duration based at least in part on an electronically stored fueling signal value and the flow shift compensation term a multi-cylinder internal combustion engine includes a control system configured to control an engine speed via outputting fueling signals having fueling signal durations based at least in part on electronically stored fueling signal values modified according to the flow shift compensation term.

20 Claims, 4 Drawing Sheets

FUEL INJECTOR FLOW SHIFT COMPENSATION IN INTERNAL COMBUSTION ENGINE

TECHNICAL FIELD

The present disclosure relates generally to systems and strategies for diagnosing and compensating for changed performance of an internal combustion engine subsystem over time, and relates more particularly to compensating for fuel injector flow shift in a multi-cylinder internal combustion engine.

BACKGROUND

A variety of strategies have been developed over the years for controlling engine speed in an internal combustion engine. Engine speed is commonly expressed in crankshaft revolutions per minute, or RPM. In one known strategy, a fueling map where fueling signal duration is mapped to requested engine speed is populated when an engine is assembled and tested at a factory, or otherwise prior to being placed in service. Such engine fueling maps typically define an on-time for a fuel injector electrical actuator which is mapped to an engine speed request expressed in RPM. Accordingly, an operator or engine control system can utilize an input device to request a specified speed, and the associated engine control system determines a fueling signal duration which corresponds to the requested engine speed. While such a strategy provides a relatively straightforward means for controlling engine speed, it has long been recognized that closed loop control will tend to enable a control system to achieve a desired engine speed more rapidly and in a generally automatic fashion. In a typical closed loop engine speed control strategy, and engine speed sensor outputs sensor signals indicative of a rotational speed of an engine crank shaft, fly wheel, etc., and a computer compares the sensed engine speed with the requested engine speed and responsively outputs an engine speed error signal. The computer will loop through a control routine numerous times, outputting fueling signal commands refined according to the engine speed error signal until the requested engine speed is achieved.

As mentioned above, conventional engine speed control strategies rely upon map data determined under a given set of operating conditions prior to placing the engine in service. Engine fueling maps may be updated periodically throughout a service life of an engine by running diagnostics and the like. Diagnostics are typically performed to compensate for changes in engine behavior which result from breaking in of the engine, in particular mechanical wear of certain components and changes in component responsiveness. Changes in fuel injector performance an variation among fuel injectors in performance over the course of an engine's service life will be familiar to those skilled in the art. Various electronic trimming strategies and fuel injector performance diagnostics to identify faulty injectors are also well known. Conventional strategies for addressing changes in fuel injector performance, or general unpredictability of fuel injector performance among a group of injectors of a given fuel system, have various drawbacks.

SUMMARY

In one aspect, a method of operating a fuel injected multi-cylinder internal combustion engine includes the steps of determining a pre-flow shift value indicative of a pre-flow shift fueling signal duration linked with an engine test speed, and determining a post-flow shift value indicative of a post-flow shift fueling signal duration linked with the engine test speed. The method further includes a step of establishing a flow shift compensation term at least in part by comparing the pre-flow shift value with the post-flow shift value. The method still further includes a step of controlling an engine speed via a step of outputting fueling signals from an engine governor to a plurality of fuel injectors of the internal combustion engine. The fueling signals include a fueling signal duration based at least in part on, an electronically stored fueling signal value and the flow shift compensation term.

In another aspect, an internal combustion engine includes an engine housing defining a plurality of engine cylinders, a plurality of pistons coupled one with each of the plurality of cylinders and an engine crankshaft coupled with the plurality of pistons. The internal combustion engine further includes an engine speed sensor configured to output engine speed signals and a plurality of electronically controlled fuel injectors associated one with each of the plurality of engine cylinders. The internal combustion engine further includes a control system having an electronic control unit coupled with the engine speed sensor and coupled with a computer readable memory. The computer readable memory stores a flow shift compensation term corresponding to a difference between a pre-flow shift value indicative of a fueling signal duration linked with a test speed of the internal combustion engine and a post-flow shift value indicative of a different fueling signal duration linked with the test speed. The electronic control unit is configured to control an engine speed of the internal combustion engine via outputting fueling signals to the plurality of electronically controlled fuel injectors, and is further configured to calculate a fueling signal duration for the fueling signals at least in part via reading electronically stored fueling signal values and modifying the electronically stored fueling signal values according to the flow shift compensation term.

In still another aspect, a control system for an internal combustion engine includes an engine speed sensor configured to output engine speed signals indicative of an engine speed of the internal combustion engine, and a plurality of fuel injector electrical actuators for controlling fuel injection in the internal combustion engine via a plurality of electronically controlled fuel injectors. The control system further includes a computer readable memory storing fueling signal values and an electronic control unit coupled with the engine speed sensor, the plurality of fuel injector electrical actuators and the computer readable memory. The electronic control unit is configured via outputting fueling signals to the plurality of fuel injector electrical actuators and receiving engine speed signals from the engine speed sensor to determine a flow shift compensation term corresponding to a difference between a pre-flow shift value indicative of a fueling signal duration linked with an engine test speed and a post-flow shift value indicative of a different fueling signal duration linked with the engine test speed. The electronic control unit is further configured to control an engine speed in the internal combustion engine via outputting fueling signals to the plurality of fuel injector electrical actuators which have a fueling signal duration based at least in part on the stored fueling signal values and of the flow shift compensation term.

DETAILED DESCRIPTION

Figure 1:
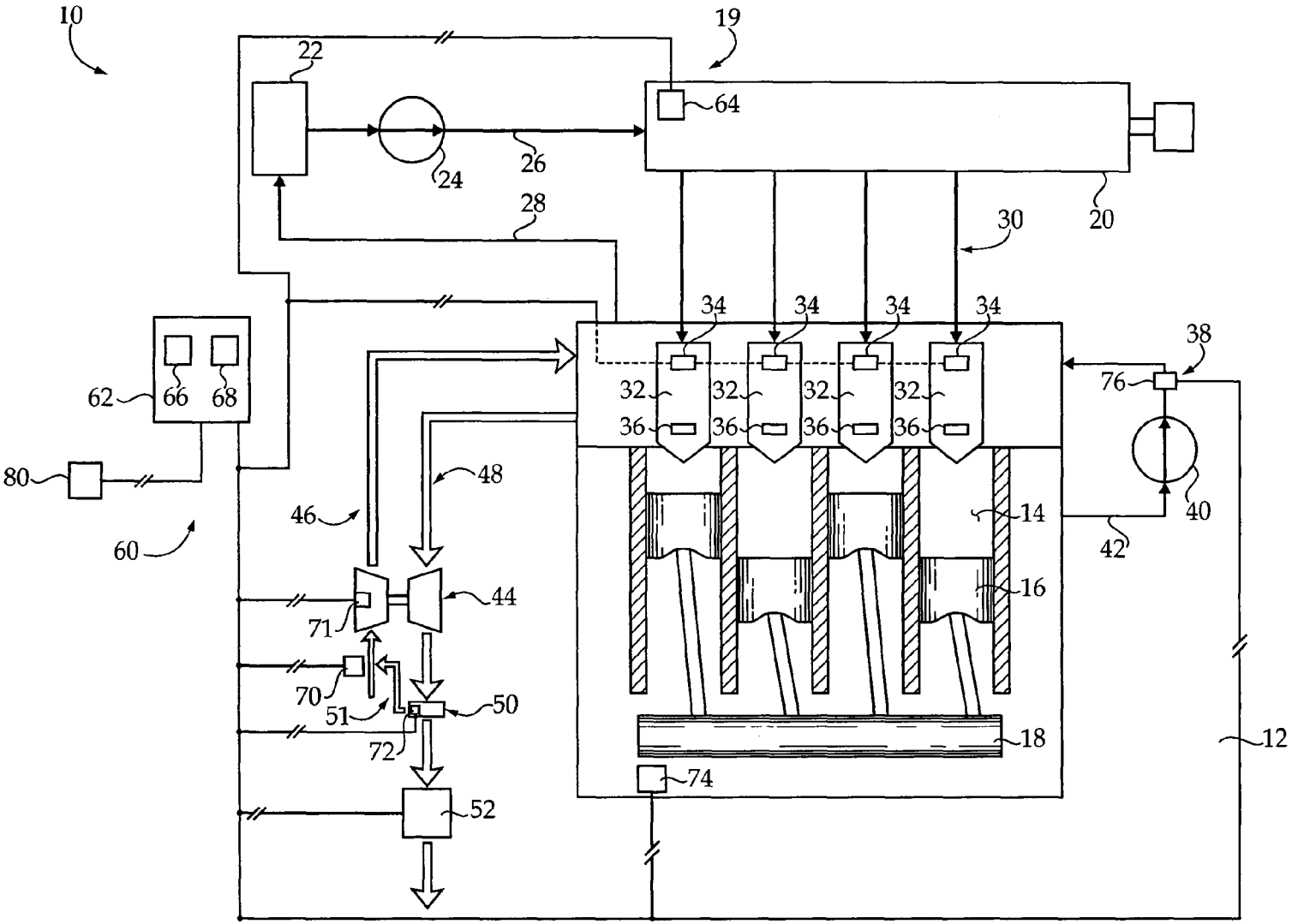
FIG. 1 is a side diagrammatic view of an internal combustion engine according to one embodiment.

Referring to FIG. 1, there is shown an internal combustion engine 10 according to one embodiment. Internal combustion engine 10 may include a fuel injected multi-cylinder engine having an engine housing 12 defining a plurality of cylinders 14. A plurality of pistons are positioned one within each of cylinders 14 and movable therein. Pistons 16 are each coupled with a crankshaft 18 in a conventional manner. In one embodiment, engine 10 may be a compression ignition engine such as a diesel engine, but in other embodiments might be a different type of combustion engine. Hence, each of pistons 16 may be configured to increase a pressure within a corresponding one of cylinders 14 to an autoignition threshold. Engine 10 may further include a fuel system 19 which includes a plurality of electronically controlled fuel injectors 32 each configured to inject a fuel for a controllable fueling duration into one of cylinders 14.

In one embodiment, engine 10 may be a direct injection engine where fuel injectors 32 are each positioned partially within a corresponding one of cylinders 14. Each of fuel injectors 32 may include an electrical actuator 34 such as a solenoid actuator or a piezoelectric actuator which is configured to change in electrical energy state to control the position of an injection valve 36. In one embodiment, injection valves 36 may include control valves which vary a pressure acting on a control surface of an outlet check (not shown) in a conventional manner. Controlling a duration of fuel injector control commands to each of electrical actuators 34 as further described herein may be used to vary an amount of fuel injected by each of fuel injectors 32 from one engine cycle to the next to control an engine speed in engine 10. As will be further apparent from the following description, the present disclosure may be implemented in the context of improving speed control in internal combustion engines, and in particular compensating for changes in fueling for a given fuelling signal duration which result from a phenomenon known as fuel injector flow shift.

Fuel system 19 may further include a fuel tank 22, which is connected with a common rail 20 via a fuel supply conduit 26. A fuel pump 24 may be positioned within fuel supply conduit 26 to provide pressurized fuel to common rail 20 in a conventional manner. A fuel return conduit or drain conduit 28 may extend from engine housing 12 to fuel tank 22. A plurality of fuel supply lines 30 may fluidly connect common rail 20 with each one of fuel injectors 32. While a common rail design provides one practical implementation strategy, in other embodiments engine 10 might include unit pumps such as cam actuated pumps, or even a combination cam-driven and common rail system. As alluded to above, engine 10 may be a diesel engine fueled via supplying a diesel fuel to common rail 20. Multiple different types of fuel may be used, such as winter diesel, summer diesel, biodiesel, or still other fuels such as JP8. It should be understood, however, that the present disclosure is applicable to non-diesel engines except as otherwise noted.

Engine 10 may further include a cooling system 38, such as a conventional engine coolant circulation system having a cooling conduit 42 adapted to circulate engine coolant or the like through engine housing 12 via a pump 40. Engine 10 may also include a turbocharger 44 positioned to receive exhaust gases passed out of engine housing 12 via an exhaust pathway 48. In a conventional manner, turbocharger 44 may also include a compressor positioned within an intake pathway 46 to compress intake air for supplying to engine housing 12. An exhaust gas recirculation mechanism such as an EGR valve 50 may also be positioned to receive exhaust gases in exhaust pathway 48. EGR valve 50 may control a relative amount of exhaust gases which are recirculated via an EGR loop 51 to intake pathway 46. EGR loop 51 may connect with intake pathway 46 upstream turbocharger 44 in one embodiment. Exhaust gases passing through exhaust pathway 48 may also be directed through an exhaust particulate filter 52 in a conventional manner.

Engine 10 may further include an engine control system 60 having an electronic control unit 62 which includes a computer such as a digital microprocessor 68 and a computer readable memory 66 coupled with microprocessor 68. Computer readable memory 66 may include RAM, ROM, flash memory or any other suitable electronic storage medium. Microprocessor 68 may likewise be any of a wide variety of suitable processors, and in one embodiment may include a digital engine speed governor. As will be understood by those skilled in the art, a digital engine speed governor typically receives engine speed requests from an operator input device or from another microprocessor and responsively outputs fueling control commands mapped to engine speed. To this end, computer readable memory 66 may store engine speed to fueling maps defining a signal duration for fueling signals sent via processor 68 to each of electrical actuators 34. Additional electronic storage media and additional microprocessors may also be used, and it should therefore be appreciated that the depiction of electronic control unit 62 in FIG. 1 is purely illustrative. For instance, in certain embodiments, control functions for engine 10 such as speed governing may be performed by a first microprocessor such as microprocessor 68. Other functions such as flow shifts compensation calculations as further described herein might be performed by a second microprocessor. Microprocessor 68 may also include a memory writing device configured to store data in a computer readable format on memory 66, also as further described herein.

Control system 60 may further include a plurality of sensors configured to monitor a plurality of different engine operating parameters. One practical implementation strategy includes hard wiring each of the plurality of sensors to electronic control unit 32 via a communications bus or the like. To this end, electronic control unit 62 may include appropriate input interface(s) (not shown) for receiving sensor data, and may also be configured via the same or a separate input interface to receive data inputs from a different processor. Certain engine operating parameters such as engine load may in fact be monitored or determined by processing data from multiple sensors and/or based on control signal data rather than via an input from a single sensor. It should thus be appreciated that electronic control unit 62 may be configured to receive electronic inputs including either sensor signals or data signals which are indicative of a plurality of different engine operating parameters, and is not limited to any particular architecture and/or type or number of processors, input interfaces, etc.

In one embodiment, a fuel pressure sensor 64 may be coupled with common rail 20 and configured to output signals to electronic control unit 62 which are indicative of a fuel pressure in common rail 20. A temperature sensor 76 may be positioned within cooling conduit 42 and configured to output signals to electronic control unit 62 which are indicative of a temperature of coolant circulated in cooling system 38. An engine speed sensor 74 may be coupled with crankshaft 18 and configured to output signals indicative of a rotational speed of crankshaft 18. Electronic control unit 62 may thus be configured via receipt of signals from engine speed sensor 74 to monitor a rotational speed of engine 10. An EGR valve position sensor 72, or another suitable sensing mechanism, may also be provided and coupled with electronic control unit 62 to enable electronic control unit 62 to determine an exhaust gas recirculation amount/rate in a conventional manner. An intake airflow sensor 70, such as a throttle position sensor or the like, may also be provided and positioned within intake pathway 46 such that sensor 70 outputs signals to electronic control unit 62 indicative of an intake airflow amount/rate during operating engine 10. Electronic control unit 62 may also be coupled with exhaust particulate filter 52, or with control mechanisms therefor, to enable electronic control unit 62 to determine a regeneration state, such as a regeneration-on or regeneration-off state, of exhaust particulate filter 52. A boost pressure sensor 71 may also be coupled with turbocharger 44 in one embodiment. Other engine operating parameters may also be monitored via control system 60, such as intake air temperature, exhaust temperature, exhaust pressure, exhaust gas constituents, and a variety of other engine operating parameters which are conventionally monitored in modern compression ignition diesel engines. Control system 60 may further include an input device 80 coupled with electronic control unit 62. Input device 80 may include an operator input device such as a throttle control which communicates a requested engine speed signal to electronic control unit 62. Input device 80 might also include a computer control device for automatically controlling engine speed.

Electronic control unit 62 may be configured by way of processor 68 to execute one or more control algorithms which include computer executable code stored on computer readable memory 66. In one embodiment, a first control algorithm or flow shift diagnostic algorithm is resident on computer readable memory 66. Electronic control unit 62 may acquire data regarding fuel injector flow shift via executing the first control algorithm in one embodiment. In particular, engine 10 may be operated via executing the first control algorithm to determine a pre-flow shift value indicative of a pre-flow shift value linked with an engine test speed.

Determining a pre-flow shift value indicative of pre-flow shift fueling signal duration linked with an engine test speed may include operating engine 10 at a test speed, which may be a pre-determined test speed such as a low idle speed. Determining the pre-flow shift value may further take place prior to placing engine 10 in service, but the present disclosure is not thereby limited. Determining the pre-flow shift value may further include operating engine 10 at the test speed via outputting first fueling signals in a first set of engine test cycles to each of fuel injector electrical actuators 34, and recording a fueling signal duration of the first fueling signals. In other words, engine 10 may be operated at the test speed and a fueling signal duration which results in engine 10 operating at the test speed can be electronically recorded. In one embodiment, the pre-flow shift value may include a fueling signal duration in milliseconds which corresponds with an on-time of fuel injector electrical actuators 34 which results in engine 10 operating at the engine test speed for a plurality of successive engine cycles.

In one embodiment, determining the pre-flow shift value may further include operating engine 10 at a plurality of different engine operating points in a plurality of different sets of engine test cycles. In general, it may be desirable to determine the pre-flow shift value under stable engine operating conditions. To this end, electronic control unit 62 may determine responsive to signals from each of the plurality of sensors of control system 60, whether engine 10 is in fact operating at a stable operating point. In one embodiment, a stable operating point may be defined as a condition where electronic inputs received by electronic control unit 62 satisfy test criteria. One example set of test criteria may include the following: (1) engine speed is at or close to low idle; (2) engine ancillary load is zero; (3) engine 10 is not decelerating and is not accelerating; (4) air conditioner is off; (5) filter 52 is not regenerating; (6) fuel injection timing is at a predefined timing; and (7) coolant temperature, intake airflow, boost pressure and fuel pressure are all above a pre-defined minimum but below a pre-defined maximum. The specific values or value ranges for the various monitored parameters, such as the minima and maxima mentioned above, may be determined empirically via known techniques. For example, engine 10 might be operated under different conditions, with each of various parameters corresponding to the electronic inputs varied, and one or more stable operating points identified where fueling signals of a particular fueling signal duration induce a detectable and repeatable engine RPM. In other words, the test criteria may be determined by performing tests on engine 10 to identify values or value ranges for the respective electronic inputs where a given fueling signal duration results in and is therefore linked with a particular engine speed. As mentioned above, engine 10 may be operated at a plurality of different engine operating points in a plurality of different sets of engine test cycles to determine the pre-flow shift value.

Engine 10 may further be operated via executing the first control algorithm or a second control algorithm to determine a post-flow shift value indicative of a post-flow shift fueling signal duration linked with the engine test speed. As discussed above, over the course of a service life of engine 10, performance and behavior of fuel injectors 32 may change. For instance, fueling signals of a given duration which initially enabled electronic control unit 62 to achieve a particular engine speed in a given amount of time may no longer allow electronic control unit 62 to achieve that engine speed as rapidly. This phenomenon is due at least in part to the fact that fuel injectors 32 have experienced wear of various of their components, resulting in a change in response time and changes in fueling amount for a given fueling signal duration. Accordingly, determining a post-flow shift value indicative of a post-flow shift fueling signal duration linked with the engine test speed can be expected to result in determining a post-flow shift value which is different from the pre-flow shift value.

The present disclosure leverages this difference between a pre-flow shift value and the post-flow shift value to establish a flow shift compensation term at least in part by comparing the pre-flow shift value with the post-flow shift value and using the flow shift compensation term to modify engine fueling map values to allow a requested engine speed to be achieved relatively more quickly than what might otherwise be possible. Determining a post-flow shift value may include operating engine 10 at the test speed via outputting second fueling signals in a second set of engine test cycles to fuel injector electrical actuators 34, and recording a fueling signal duration of the second fueling signals.

As discussed above, input device 80 may be configured to provide a requested engine speed signal to electronic control unit 62. In one embodiment, electronic control unit 62 may receive a requested engine speed signal from input device 80 and may responsively read a stored fueling signal value from a fueling map stored on computer readable memory 66. Electronic control unit 62 may further modify the stored fueling signal value according to the flow shift compensation term. Thus, rather than outputting fueling signals defined by the subject fueling, map, electronic control unit 62 may output fueling signals which are fueling map signals modified such as by multiplying according to the flow shift compensation term. To this end, the flow shift compensation term may include a multiplier term based on a difference between the pre-flow shift value and the post-flow shift value. Controlling an engine speed may thus include multiplying an electronically stores fueling signal value by the flow shift compensation term.

Controlling an engine speed in internal combustion engine 10 may further include controlling an engine speed in a closed loop manner. To this end, electronic control unit 62 may be configured to control an engine speed via executing a closed loop engine speed control algorithm comprising computer executable code stored on computer readable memory 66.

Figure 4:
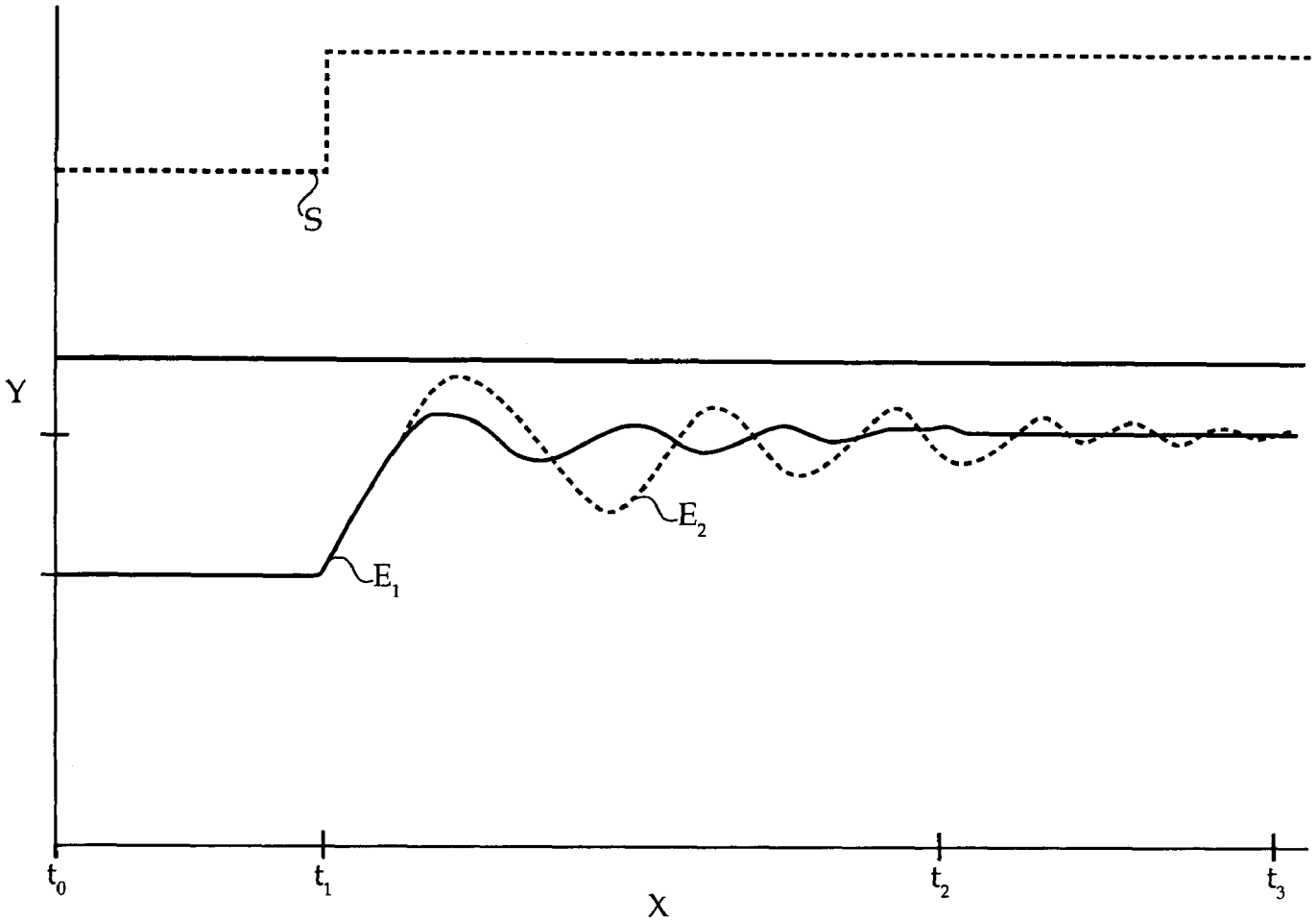
FIG. 4 is a graph illustrating an engine speed change over time for an engine according to the present disclosure in comparison with a conventional engine.

Referring to FIG. 4, there is shown a graph wherein the Y-axis represents signal value and the X-axis represents time. In FIG. 4, a first curve S is shown representing a signal value for a requested engine speed signal. It may be noted that curve S indicates a first signal value from a first time $T_0$ to a second time $T_1$, and subsequently illustrates a higher signal value corresponding to a requested increase in engine speed. FIG. 4 further shows a second curve $E_1$ identifying . . . .

INDUSTRIAL APPLICABILITY

Figure 2B:
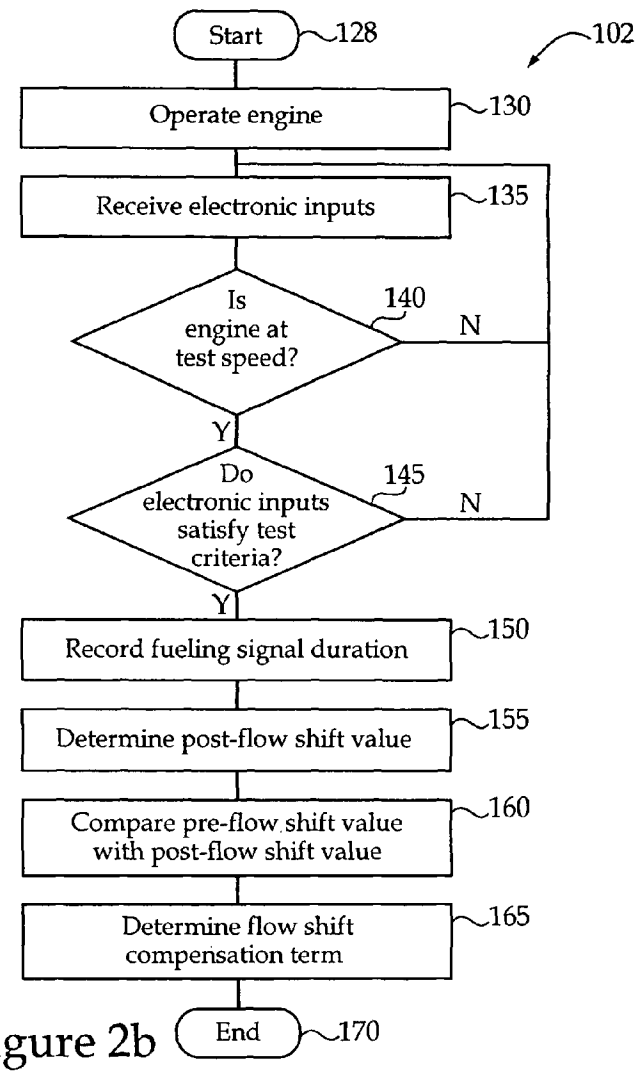
FIG. 2B is a flow chart illustrating another example control process, according to one embodiment.
Figure 2A:
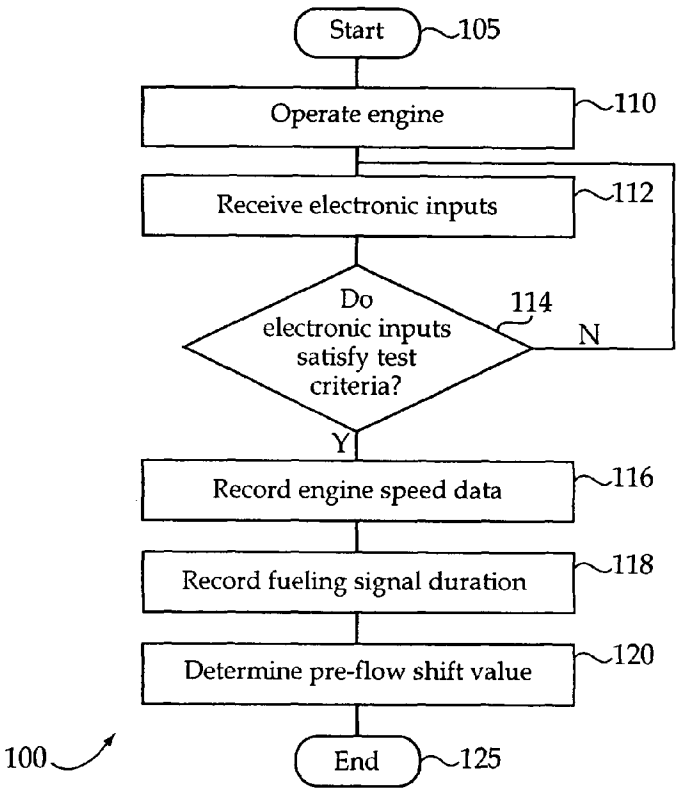
FIG. 2A is a flow chart illustrating an example data acquisition process according to one embodiment.

Referring to FIG. 2A, there is shown a flow chart 100 illustrating an example control routine whereby electronic control unit 62 determines a pre-flow shift value according to one embodiment. The process of flow chart 100 may start at step 105, and may proceed to step 110 to operate engine 10. From step 110, the process may proceed to step 112 to receive electronic inputs via electronic control unit 62 as described herein. The electronic inputs may include, for example, sensor inputs received via some or all of the sensors of control system 60. From step 112, the process may proceed to step 114 wherein an electronic control unit 62 may query whether the electronic inputs satisfy test criteria as described herein. If no, the process may loop back to repeat steps 112 and 114 again. If yes, the process may proceed ahead to step 116 where electronic control unit 62 may record engine speed data on computer readable memory 66. At step 116, electronic control unit 62 may record an engine speed which will serve as the engine test speed, for example. In other embodiments, the engine test speed might be pre-determined.

From step 116, the process may proceed to step 118 where electronic control unit 62 may record a fueling signal duration which is linked with the engine test speed. In other words, at step 118 electronic control unit 62 may be understood as recording a duration of fueling signals output from electronic control unit 62 to fuel injector electrical actuators 34 which results in the engine speed recorded in step 116. From step 118, the process may proceed to step 120 to determine a pre-flow shift value. In one embodiment, the pre-flow shift value may be a numerical value corresponding to the fueling signal duration recorded in step 118. From step 120, the process may proceed to end at step 125.

Referring now to FIG. 2B, there is shown a flow chart 102 illustrating an example control process according to one embodiment where electronic control unit 62 determines a flow shift compensation term as described herein. The process of flow chart 102 may start at step 128, and may proceed to step 130 to operate engine 10. From step 130, the process may proceed to step 135 where electronic control unit may receive electronic inputs. In one embodiment, the electronic inputs received in step 135 may be the same as those received in step 112 of flow chart 100. From step 135, the process may proceed to step 140 to query whether engine 10 is at the test speed. In other words, at step 140 electronic control unit 62 may be determining whether engine 10 is operating at the test speed which is the same as the test speed recorded in connection with step 116 of flow chart 100. If no, the process may lead back to execute steps 135 and 140 again. If yes, the process may proceed to step 145 to query whether the electronic input satisfy test criteria. The test criteria at step 145 may be the same or substantially, the same as the test criteria considered at step 114 of flow chart 100. If no, the process may return to execute steps 135-145 again. If yes, the process may proceed to step 150 where electronic control unit 62 may record a fueling signal duration linked with the engine test speed.

As explained above, the fueling signal duration recorded at step 150 may be expected to be a different fueling signal duration than that associated or linked with the test speed when engine 10 is at an earlier stage in its service life, or prior to ever being placed in service. From step 150, the process may proceed to step 155 to determine the post flow shift value as described herein. From step 155, the process may proceed to step 160 to compare the pre-flow shift value with the post flow shift value.

In step 160, electronic control unit 62 may be determining an arithmetic difference between the pre-flow shift value and the post-flow shift value, for example. From step 160, the process may proceed to step 165 where electronic control unit 62 may determine the flow shift compensation term. As explained above, the flow shift compensation term may include a multiplier term which electronic control unit 62 utilizes to modify stored fueling signal values from a fueling map.

Figure 3:
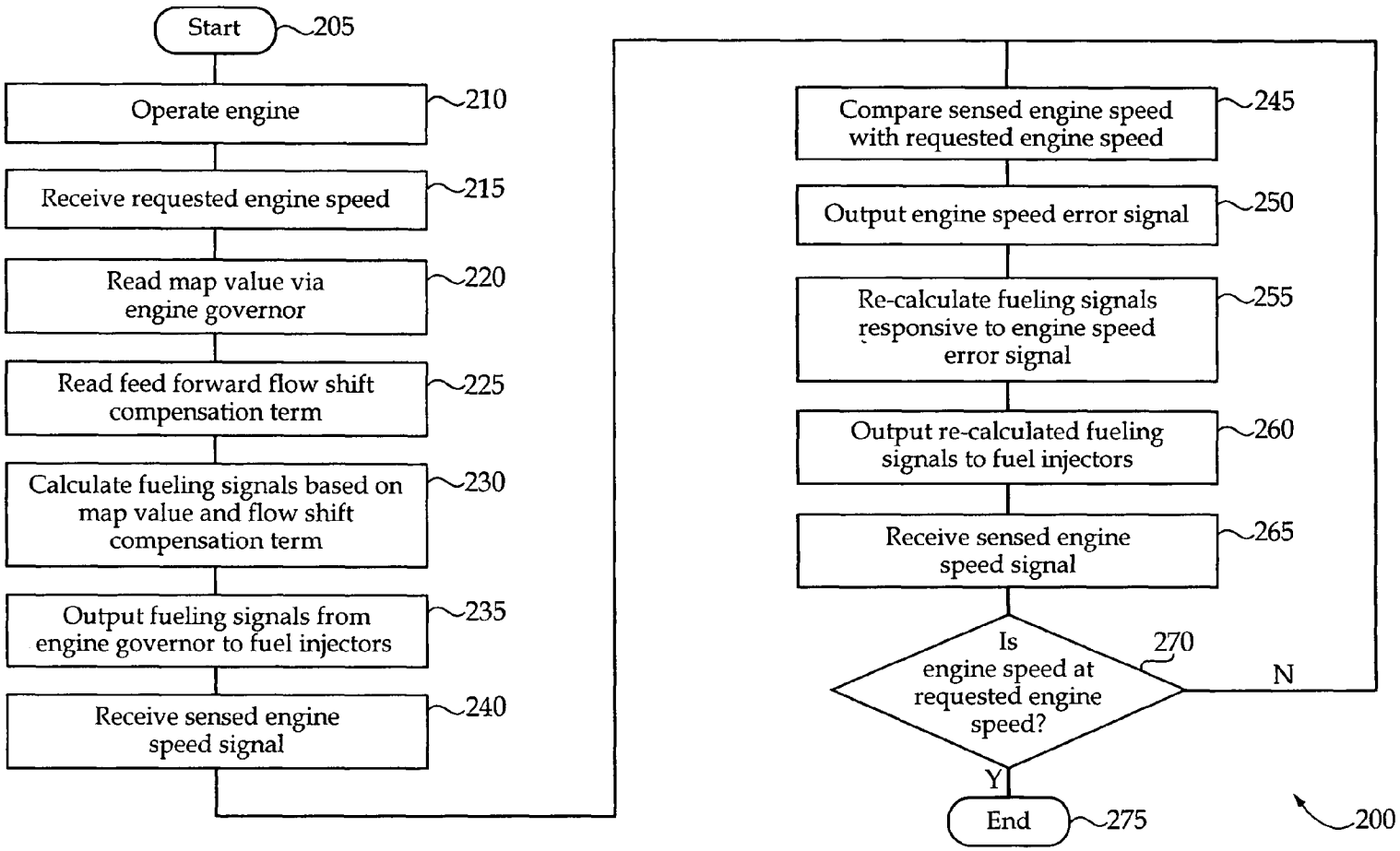
FIG. 3 is a flow chart illustrating an example engine operating process according to one embodiment.

Referring now to FIG. 3, there is shown yet another flow chart 200 illustrating an example process according to the present disclosure for controlling engine speed in engine 10. The process of flow chart 200 may start at step 205, and may proceed to step 210 to operate engine 10. From step 210, the process may proceed to step 215 to receive a requested engine speed signal, for example a signal input via input device 80. From step 215, the process may proceed to step 220 where electronic control unit 62, and in particular data processor 68, may read a stored map value from computer readable memory 66.

From step 220, the process may proceed to step 225 where electronic control unit 62 may read the electronically stored feed forward flow shift compensation term, also stored on computer readable memory 66 in one embodiment. From step 225, the process may proceed to step 230 where electronic control unit 62 may calculate fueling signals based on the stored map value and the flow shift compensation term. As described herein, the fueling signals may be calculated by multiplying the stored map values by the flow shift compensation term. From step 230, the process may proceed to step 235 where electronic control unit 62 may output fueling signals to fuel injectors 32. In particular, at step 235 processor 68 may output fueling signals to fuel injector electrical actuators 34.

From step 235, the process may proceed to step 240 where electronic control unit 62 may receive a sensed engine speed signal, for example from sensor 74. From step 240 the process may proceed to step 245 where electronic control unit 62 may compare the sensed engine speed with the requested engine speed. From step 245, the process may proceed to step 250 where electronic control unit 62 may output an engine speed error signal. From step 250, the process may proceed to step 255 where electronic control unit 62 may re-calculate fueling signals responsive to the engine speed error signal. From step 255, the process may proceed to step 260 where electronic control unit 62 may output the re-calculated fueling signals to fuel injectors 32. From step 260, the process may proceed to step 265 to again receive a sensed engine speed signal. From step 265, the process may proceed to step 270 where electronic control unit 62 may query whether engine speed is at the requested engine speed. If no, the process may loop back to execute steps 245-270 again. If yes, the process may end at step 275.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A method of operating a fuel injected multi-cylinder internal combustion engine comprising the steps of:

determining a pre-flow shift value indicative of a pre-flow shift fueling signal duration linked with an engine test speed;

determining a post-flow shift value indicative of a post-flow shift fueling signal duration linked with the engine test speed;

establishing a flow shift compensation term at least in part by comparing the pre-flow shift value with the post-flow shift value; and controlling an engine speed via a step of outputting fueling signals from an engine governor to a plurality of fuel injectors of the internal combustion engine, the fueling signals having a fueling signal duration based at least in part on, an electronically stored fueling signal value and the flow shift compensation term.

2. The method of claim 1 wherein the step of establishing the flow shift compensation term further includes calculating a multiplier term based on a difference between the pre-flow shift value and the post flow-shift value, and wherein the step of controlling an engine speed further includes a step of multiplying the electronically stored fueling signal value by the flow shift compensation term.

3. The method of claim 1 further comprising the steps of receiving a requested engine speed signal, receiving a sensed engine speed signal and outputting an engine speed error signal based on a difference between the requested engine speed signal and the sensed engine speed signal, wherein the step of controlling an engine speed further includes controlling engine speed responsive to the engine speed error signal.

4. The method of claim 3 wherein the flow shift compensation term includes a feed forward flow shift compensation term, and wherein the step of controlling an engine speed further includes a step of executing a closed loop engine speed control algorithm which includes the feed forward flow shift compensation term.

5. The method of claim 4 wherein the electronically stored fueling signal value includes an electronically stored fueling signal value mapped to engine speed, and wherein the step of controlling an engine speed further includes a step of modifying the electronically stored fueling signal value via the feed forward flow shift compensation term.

6. The method of claim 4 wherein the step of controlling an engine speed further includes adjusting engine speed via a sinusoidal engine speed hunting profile defining a governor response time, and further comprising the steps of limiting an amplitude of the sinusoidal engine speed hunting profile and limiting the governor response time at least in part via multiplying the electronically stored fueling signal value via the flow shift compensation term.

7. The method of claim 1 wherein:

the step of determining a pre-flow shift value includes the steps of operating the engine at the test speed via outputting first fueling signals in a first set of engine test cycles to each of a plurality of fuel injector electrical actuators, and recording a fueling signal duration of the first fueling signals; and the step of determining a post-flow shift value further includes the steps of operating the engine at the test speed via outputting second fueling signals in a second set of engine test cycles to the plurality of fuel injector electrical actuators, and recording a fueling signal duration of the second fueling signals.

8. The method of claim 7 wherein the step of determining a pre-flow shift value further includes operating the engine at a plurality of different engine operating points in a plurality of different sets of engine test cycles, and wherein the step of determining a post-flow shift value further includes operating the engine at the plurality of different engine operating points in another plurality of different sets of engine test cycles.

9. The method of claim 8 wherein the steps of determining a pre-flow shift value and determining a post-flow shift value each include a step of commanding fuel injection via a common rail fuel system of the internal combustion engine which includes the plurality of fuel injectors, and further comprising a step of compression igniting a fuel injected via each of the fuel injectors into a corresponding one of the plurality of cylinders.

10. The method of claim 1 further comprising the steps of:

shifting a fuel injector flow a first time subsequent to determining the pre-flow shift value via operating the engine in a plurality of engine cycles;

shifting a fuel injector flow a second time subsequent to determining the post-flow shift value via operating the engine in another plurality of engine cycles; and updating the flow shift compensation term subsequent to shifting the fuel injector flow a second time.

11. The method of claim 10 wherein the post-flow shift value includes a first post-flow shift value, and wherein the step of updating the flow shift compensation term includes determining a second post-flow shift value subsequent to shifting the fuel injector flow a second time, and updating the flow shift compensation term based on a difference between the second post-flow shift value and at least one of, the pre-flow shift value and the first post-flow shift value.

12. An internal combustion engine comprising:

an engine housing defining a plurality of engine cylinders, a plurality of pistons coupled one with each of the plurality of cylinders and an engine crankshaft coupled with the plurality of pistons;

an engine speed sensor configured to output engine speed signals;

a plurality of electronically controlled fuel injectors associated one with each of the plurality of engine cylinders; and a control system for the engine, including an electronic control unit coupled with the engine speed sensor and further coupled with a computer readable memory storing a flow shift compensation term corresponding to a difference between a pre-flow shift value indicative of a fueling signal duration linked with a test speed of the internal combustion engine and a post-flow shift value indicative of a different fueling signal duration linked with the test speed;

wherein the electronic control unit is configured to control an engine speed of the internal combustion engine via outputting fueling signals to the plurality of electronically controlled fuel injectors, and is further configured to calculate a fueling signal duration for the fueling signals at least in part via reading electronically stored fueling signal values and modifying the electronically stored fueling signal values according to the flow shift compensation term.

13. The internal combustion engine of claim 12 wherein the computer readable memory further stores a closed loop engine speed control algorithm, and wherein the electronic control unit is further configured to control engine speed of the internal combustion engine at least in part via executing the closed loop engine speed control algorithm and feeding forward the flow shift compensation term to the closed loop engine speed control algorithm.

14. The internal combustion engine of claim 13 wherein:

the computer readable memory stores at least one engine fueling map which includes fueling signal duration mapped to requested engine speed; and the electronic control unit is further configured to read a stored fueling signal map value from the engine fueling map and multiply the stored fueling signal map value by the flow shift compensation term, responsive to a requested engine speed signal.

15. The internal combustion engine of claim 12 wherein:

the control system includes a plurality of sensors configured to monitor a plurality of different engine parameters and the electronic control unit is further configured to receive a plurality of sensor inputs from the plurality of sensors and responsively generate a flow shift calibration signal, if the plurality of sensor inputs satisfy flow shift calibration criteria; and the post-flow shift value includes a first post-flow shift value and the electronic control unit is further configured to update the flow shift compensation term responsive to the flow shift calibration signal via determining a second post-flow shift value and comparing the second post-flow shift value with at least one of, the pre-flow shift value and the first post-flow shift value.

16. The internal combustion engine of claim 15 including a compression ignition engine wherein each of the plurality of pistons is configured to increase a pressure within a corresponding one of the plurality of cylinders to an autoignition pressure, and further comprising a fuel system that includes a common rail coupled with each of the plurality of fuel injectors.

17. A control system for an internal combustion engine comprising:

an engine speed sensor configured to output engine speed signals indicative of an engine speed of the internal combustion engine;

a plurality of fuel injector electrical actuators for controlling fuel injection in the internal combustion engine via a plurality of electronically controlled fuel injectors;

a computer readable memory storing fueling signal values; and an electronic control unit coupled with the engine speed sensor, the plurality of fuel injector electrical actuators and the computer readable memory;

the electronic control unit being configured via outputting fueling signals to the plurality of fuel injector electrical actuators and receiving engine speed signals from the engine speed sensor to determine a flow shift compensation term corresponding to a difference between a pre-flow shift value indicative of a fueling signal duration linked with an engine test speed and a post-flow shift value indicative of a different fueling signal duration linked with the engine test speed;

the electronic control unit being further configured to control an engine speed in the internal combustion engine via outputting fueling signals to the plurality of fuel injector electrical actuators which have a fueling signal duration based at least in part on the stored fueling signal values and the flow shift compensation term.

18. The control system of claim 17 wherein:

the computer readable memory stores at least one engine fueling map which includes fueling signal duration mapped to requested engine speed; and the electronic control unit is further configured to calculate a fueling signal duration for the fueling signals via multiplying a stored fueling signal map value from the engine fueling map by the flow shift compensation term, responsive to a requested engine speed signal.

19. The control system of claim 18 wherein the electronic control unit includes a digital engine speed governor.

20. The control system of claim 19 wherein the computer readable memory further stores a closed loop engine speed control algorithm, and wherein the electronic control unit is further configured to control an engine speed of the internal combustion engine at least in part via executing the closed loop engine speed control algorithm and feeding forward the flow shift compensation term to the closed loop engine speed control algorithm.

* * * * *